US009250570B2

(12) United States Patent
Matsumoto

(10) Patent No.: US 9,250,570 B2
(45) Date of Patent: Feb. 2, 2016

(54) DEVELOPING DEVICE HAVING AN OVERFLOW DISCHARGING PORTION

(71) Applicant: CANON KABUSHIKI KAISHA, Tokyo (JP)

(72) Inventor: Atsushi Matsumoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/718,197

(22) Filed: May 21, 2015

(65) Prior Publication Data

US 2015/0338778 A1 Nov. 26, 2015

(30) Foreign Application Priority Data

May 23, 2014 (JP) ..... 2014-107576

(51) Int. Cl.
*G03G 15/08* (2006.01)

(52) U.S. Cl.
CPC ..... *G03G 15/0891* (2013.01)

(58) Field of Classification Search
USPC ..... 399/254
See application file for complete search history.

(56) References Cited

U.S. PATENT DOCUMENTS 7,729,641 B2 * 6/2010 Suzuki ..... G03G 15/0808 399/119
8,045,900 B2 10/2011 Kubo et al.
8,374,528 B2 2/2013 Kubo et al.
8,848,096 B2 9/2014 Nishio
2007/0231015 A1 * 10/2007 Sakamaki ..... G03G 15/0844 399/257
2012/0251185 A1 10/2012 Matsumoto
2012/0269555 A1 10/2012 Matsumoto et al.
2015/0071683 A1 3/2015 Takahashi et al.

FOREIGN PATENT DOCUMENTS

JP 2000-112238 A 4/2000
JP 2009-058649 A 3/2009
JP 2012-234152 A 11/2012
JP 2012-234153 A 11/2012
JP 2013-231802 A 11/2013

OTHER PUBLICATIONS

Atsushi Matsumoto, U.S. Appl. No. 14/714,532, filed May 18, 2015.

* cited by examiner

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

A developing device includes: a developer carrying member; first and second feeding paths; a first screw member; a second screw member; and a discharge portion. When a ratio of a developer feeding speed in a first region to a developer feeding speed in the second region is α, a screw blade pitch of the first screw member in the second region is p1, a screw blade pitch of the first screw member in the third region is p1', a rotational speed of the first screw member is ω1, a maximum of a cross-sectional area of a flow path lower than a lower end of the discharge opening in an axially vertical cross section including the discharge opening of the first feeding path is R", and an opening area of an opening is S', the following relationship is satisfied: R"αp1/p1'≤S'≤R"p1/p1'.

9 Claims, 12 Drawing Sheets

DEVELOPING DEVICE HAVING AN OVERFLOW DISCHARGING PORTION

FIELD OF THE INVENTION AND RELATED ART

The present invention relates to a developing device of a so-called function-separation type in which a developer is supplied from a first feeding path and is carried on a rotating developer carrying member and after the developer is used in development, the developer is collected into a second feeding path.

The developing device of the function-separation type has been put into practical use.

As an example of the developing device of the function-separation type, there is a developing device of a so-called vertical stirring type in which a first feeding path and a second feeding path provided below the first feeding path are disposed and a partition wall for forming the bottom of the first feeding path is provided with a first opening and a second opening.

In the developing device, when a toner is supplied in an amount corresponding to an amount of the toner taken out with development, also a carrier is supplied and an excessive developer is caused to overflow the first feeding path through a discharge opening. That is, a so-called ATR (automatic toner replenishment) type is employed.

However, in the developing device of the function-separation type, the developer is taken out from the first feeding path and is by-passed through the rotating developer carrying member toward the second feeding path, and therefore a flow amount of the developer becomes smaller as the developer moves toward a downstream end of the first feeding path with respect to a developer feeding direction. For that reason, as disclosed in Japanese Laid-Open Patent Application (JP-A) 2012-234153, in the case where the discharge opening is disposed in the first feeding path at a downstream position of a developer carrying region of the developer carrying member, it is difficult to stably discharge the developer through the discharge opening.

Therefore, in JP-A 2012-234152, in a region along the discharge opening for a first screw member provided in the first feeding path, a screw blade is removed and a rib is formed. A feeding speed of the developer when the developer passes through the region along the discharge opening in the first feeding path is made lower than those in an upstream side and a downstream side of the region, so that a developer surface below the discharge opening is locally raised and thus discharge of the developer through the discharge opening is stabilized.

In the developing device disclosed in JP-A-234153, downsizing of the developing device by reducing a flow path area of each of the first and second feeding paths while maintaining a flow amount of the developer circulated between the first and second feeding paths was studied. Further, downsizing of the developing device by shortening a distance from a downstream end of the developer carrying region of the developer carrying member to a downstream end of a second opening by a decrease in opening area of the second opening through which the developer is delivered from the first feeding path to the second feeding path was studied.

However, even in the case where the flow path area of the second feeding path is reduced and in the case where the opening area of the second opening is decreased, it turned out that the developer stagnates at the second opening and is temporarily discharged through the discharge opening in an unintended amount. As a result of the discharge of the developer in the unintended amount, it turned out that the developer circulating between the first and second feeding paths temporarily becomes insufficient.

SUMMARY OF THE INVENTION

A principal object of the present invention is to provide a developing device in which a developer is not readily discharged in an unintended amount through a discharge opening by suppressing stagnation of a toner in the neighborhood of a second opening while achieving downsizing of the developing device.

According to an aspect of the present invention, there is provided a developing device comprising: a developer carrying member including a carrying region of a developer containing a toner and a carrier; first and second feeding paths, provided along the developer carrying member, for forming a circulating path of the developer by establishing communication through a first opening and a second opening at end portions; a first screw member, including a screw blade, for supplying the developer to the developer carrying member while feeding the developer delivered from the second feeding path through the first opening by being rotated in the first feeding path; a second screw member, including a screw blade, for feeding the developer delivered from the first feeding path through the second opening and the developer collected from the carrying region by being rotated in the second feeding path; and a discharging portion capable of discharging a part of the developer in the first feeding path through a discharge opening, provided in a first region between the carrying region and the second opening in the first feeding path, by causing the part of the developer to overflow the first feeding path, wherein the first screw member in the first region has no screw blade or has the screw blade smaller in diameter than those in a second region upstream of the first region and a third region downstream of the first region with respect to a developer feeding direction, and wherein when a ratio of a developer feeding speed in the first region to a developer feeding speed in the second region is $\alpha$, a screw blade pitch of the first screw member in the second region is p1, a screw blade pitch of the first screw member in the third region is p1', a rotational speed of the first screw member is $\omega 1$, a maximum of a cross-sectional area of a flow path lower than a lower end of the discharge opening in an axially vertical cross section including the discharge opening of the first feeding path is R", and an opening area of the second opening is S', the following relationship is satisfied: $R''\alpha p1/p1' \leq S' \leq R''p1/p1'$.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings.

Embodiment 1

Image Forming Apparatus

Figure 1:
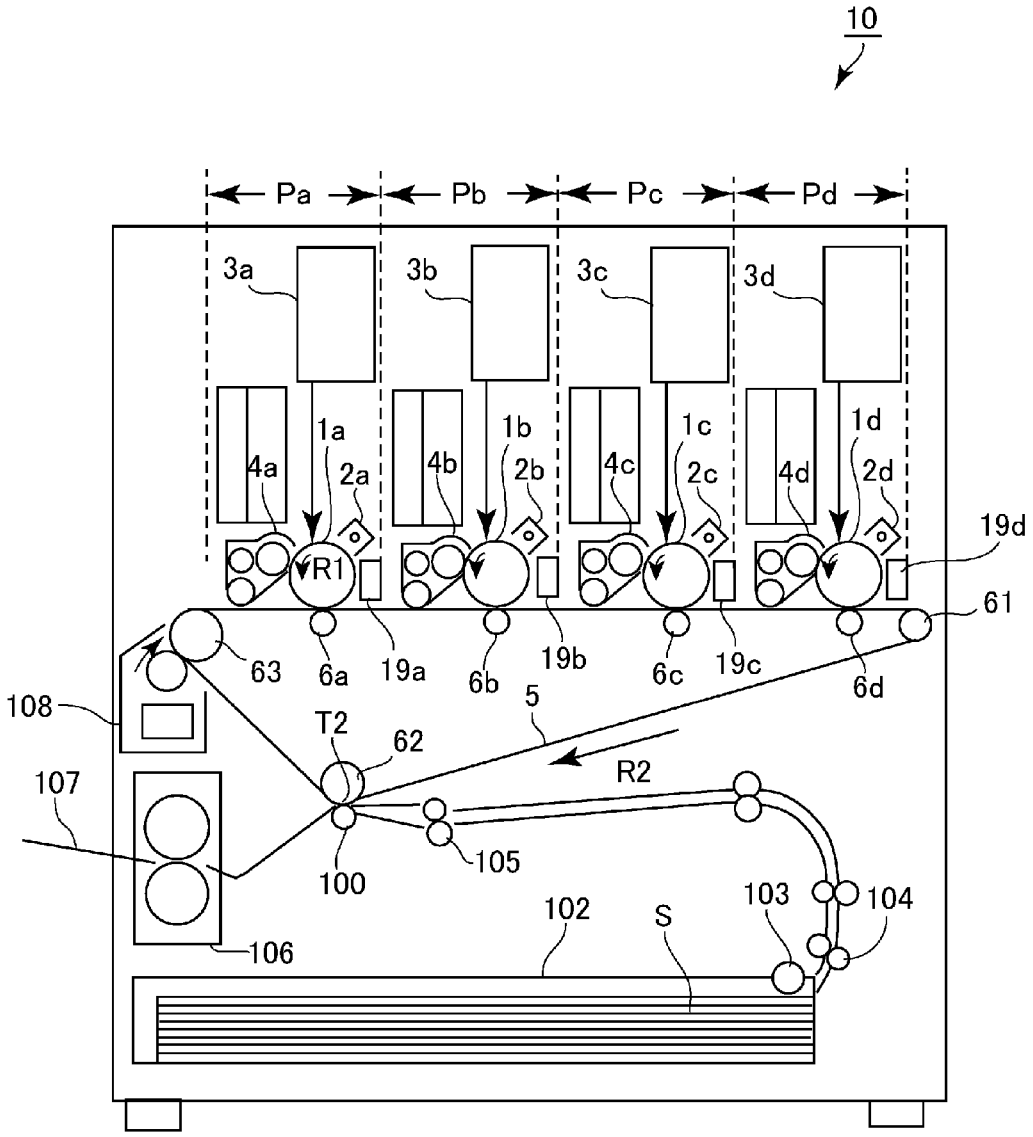
FIG. 1 is an illustration of a structure of an image forming apparatus.

FIG. 1 is an illustration of a structure of an image forming apparatus 10. As shown in FIG. 1, the image forming apparatus 10 is an intermediary transfer type full-color printer of the tandem type in which image forming portions Pa for yellow, Pb for magenta, Pc for cyan, and Pd for black are disposed along an intermediary transfer belt 5.

At the image forming portion Pa, a yellow toner image is formed on a photosensitive drum 1*a* and then is primary-transferred onto the intermediary transfer belt 5. At the image forming portion Pb, a magenta toner image is formed on a photosensitive drum 1*b* and then is primary-transferred onto the intermediary transfer belt 5. At the image forming portions Pc and Pd, a cyan toner image and a black toner image are formed on a photosensitive drum 1*c* and a photosensitive drum 1*d*, respectively, and are primary-transferred onto the intermediary transfer belt 5.

The four color toner images carried on the intermediary transfer belt 5 are conveyed to a secondary transfer portion T2, at which the four color toner images are secondary-transferred onto a recording material S.

The intermediary transfer belt 5 is supported by being extended around a tension roller 61, a driving roller 63 and an opposite roller 62 and is driven by the driving roller 63, thus being rotated in the direction indicated by an arrow R2.

A secondary transfer roller 100 is contacted to the intermediary transfer belt 5 which is supported by the opposite roller 62 at an inner surface, thus forming a secondary transfer portion T2. The recording material S pulled out from a recording material cassette 102 by a pick-up roller 103 is separated one by one by a separation roller 104 to be sent to registration rollers 105. The registration rollers 105 send the recording material S to the secondary transfer portion T2 while timing the recording material S to the toner images on the intermediary transfer belt 5.

In a process in which the recording material S is fed through the secondary transfer portion T2, a voltage is applied to the secondary transfer roller 100, so that the full-color toner images are secondary-transferred from the intermediary transfer belt 5 onto the recording material S.

The recording material S on which the four color toner images are secondary-transferred is curvature-separated from the intermediary transfer belt 5 and is sent into a fixing device 106, in which the toner images are subjected to application of heat and pressure and thus are fixed on a surface of the recording material S. Thereafter, the recording material P is discharged on a discharge tray 107.

(Image Forming Portion)

The image forming portions Pa, Pb, Pc and Pd have the substantially same constitution except that the colors of toners of yellow for a developing device 4*a* provided at the image forming portion Pa, of magenta for a developing device 4*b* provided at the image forming portion Pb, of cyan for a developing device 4*c* provided at the image forming portion Pc, and of black for a developing device 4*d* provided at the image forming portion Pd are different from each other. In the following description, the image forming portion Pa will be described and other image forming portions Pb, Pc and Pd will be omitted from redundant description.

At the image forming portion Pa, around the photosensitive drum 1*a*, a corona charger 2*a*, an exposure device 3*a*, the developing device 4*a*, a transfer roller 6*a* and a drum cleaning device 19*a* are disposed. The photosensitive drum 1*a* is constituted by forming a negatively chargeable photosensitive layer on a substrate of an aluminum cylinder and is rotated in a direction indicated by an arrow R1.

The surface of the photosensitive drum 1*a* is irradiated with charged particles accompanying corona discharge by the corona charger 2*a*, so that the surface of the photosensitive drum 1*a* is electrically charged uniformly to a negative-polarity dark portion potential VD. The exposure device 3*a* writes (forms) a latent image for an image on the charged surface of the photosensitive drum 1*a* by scanning of the charged surface through a rotation mirror with a laser beam obtained by ON-OFF modulation of scanning line image data expanded from a separated color image for yellow. The surface potential of the photosensitive drum 1*a* charged to a dark portion potential is lowered to a light portion potential VL by being subjected to the exposure, so that the negatively charged toner can be deposited on the photosensitive drum 1*a*.

The developing device 4*a* develops the electrostatic image formed on the photosensitive drum 1*a* to form the toner image as described later.

The transfer roller 6*a* urges the inner surface of the intermediary transfer belt 5 to form a primary transfer portion between the photosensitive drum 1*a* and the intermediary transfer belt 5. By applying a DC voltage to the transfer roller 6*a*, the toner image carried on the photosensitive drum 1*a* is primary-transferred onto the intermediary transfer belt 5.

The drum cleaning device 19*a* rubs the photosensitive drum 1*a* with a cleaning blade to collect transfer residual toner remaining on the photosensitive drum 1*a* without being primary-transferred onto the intermediary transfer belt 5. The belt cleaning device 108 brings a fur brush, to which a voltage is applied, in contact with the intermediary transfer belt 5, and then the transfer residual toner on the surface of the intermediary transfer belt 5 is collected.

In this embodiment, the photosensitive drum which is an organic photosensitive member is used, but an inorganic photosensitive member of an inorganic material such as amorphous silicon can also be used. In place of a drum-shaped photosensitive member, a belt-shaped photosensitive member may also be used.

The charging type, the transfer type, the cleaning type and the fixing type for the image formation are also not limited to those described above.

(Developing Device)

Figure 2:
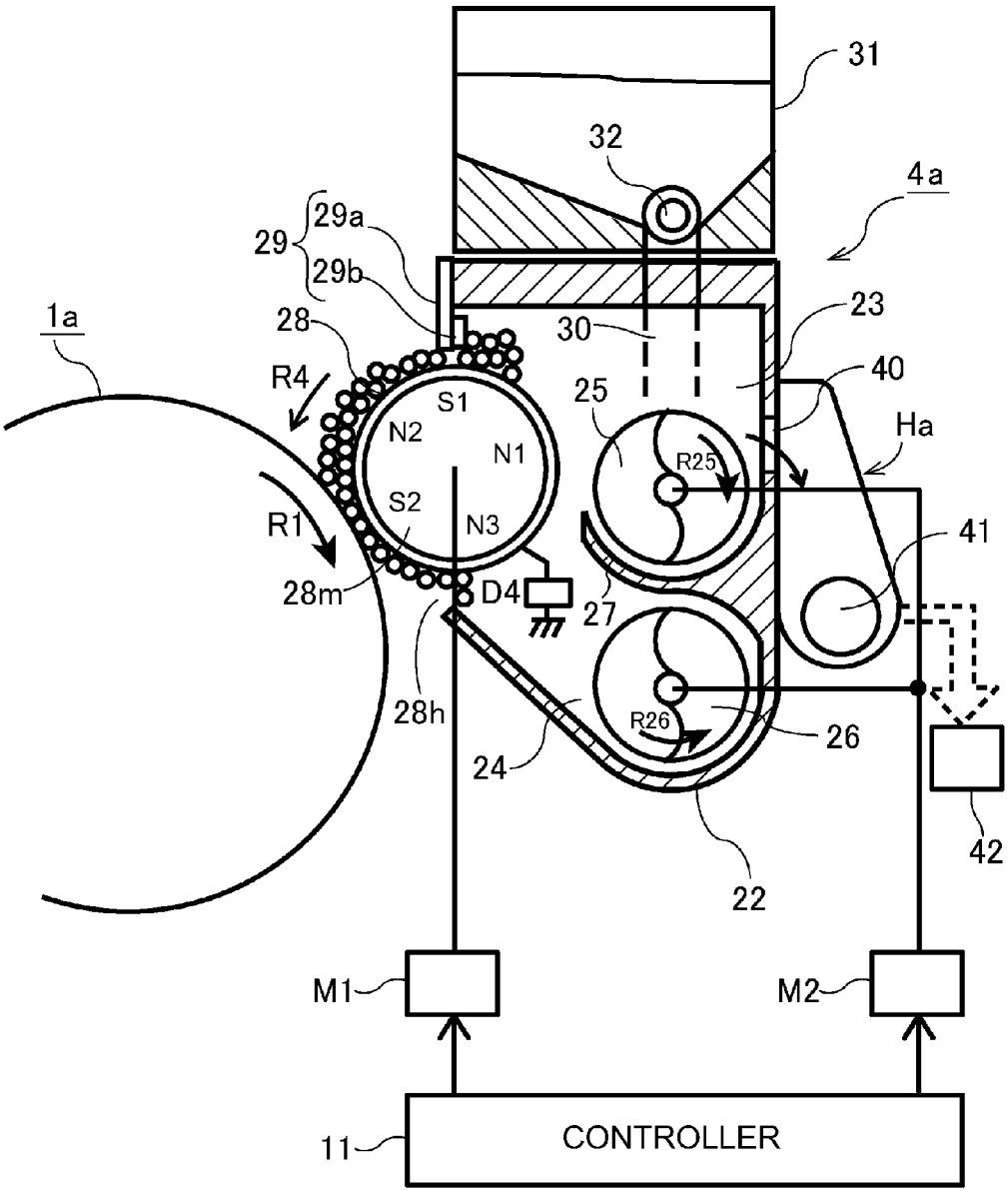
FIG. 2 is an illustration of a structure of a developing device in an axially vertical cross section.
Figure 3:
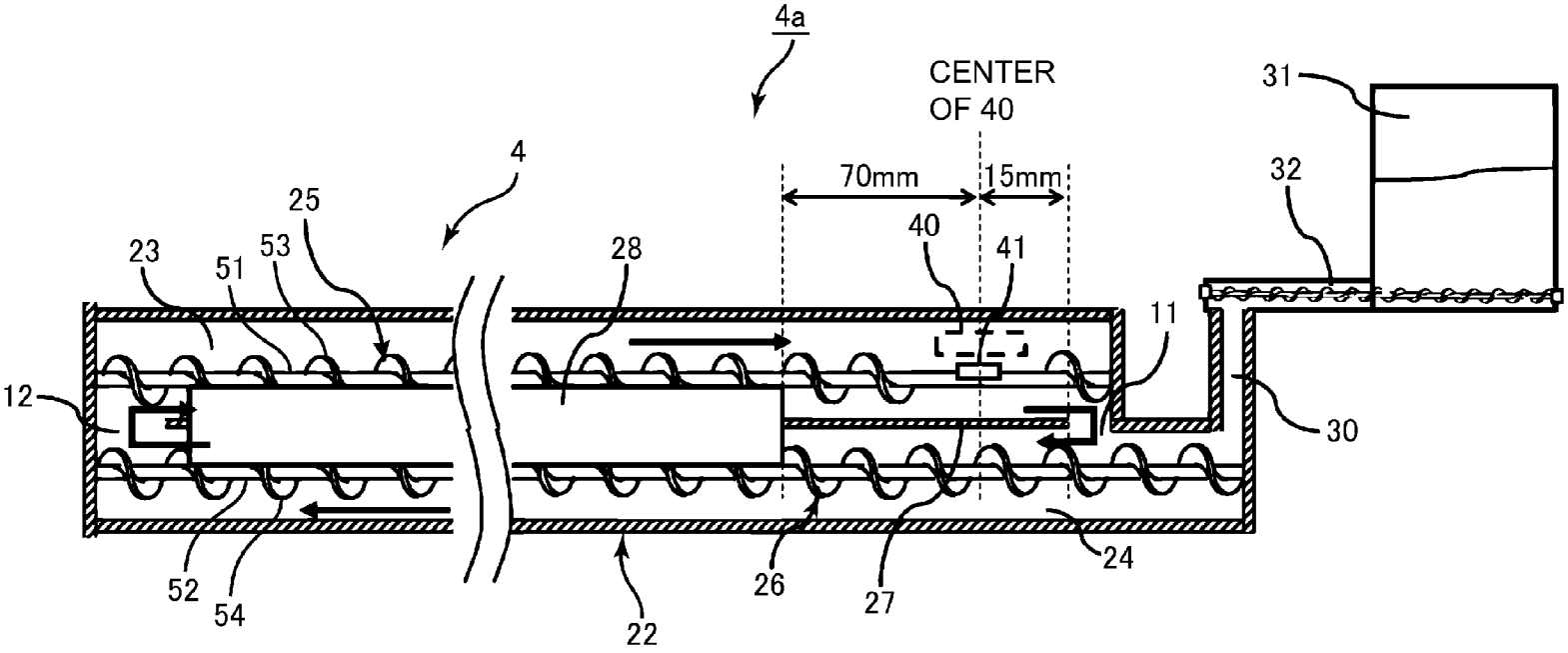
FIG. 3 is an illustration of a structure of the developing device in an axially horizontal cross section.

FIG. 2 is an illustration of a structure of the developing device in an axially vertical cross section. FIG. 3 is an illustration of the structure of the developing device in an axially horizontal cross section. As shown in FIG. 2, a developing container 22 is provided with an opening 28*a* at a position corresponding to the developing region opposing the photosensitive drum 1*a*. A developing sleeve 28 is disposed rotatably so as to be partly exposed toward the photosensitive drum 1*a* through the opening 28*a*. The developing sleeve 28 develops the electrostatic image on the photosensitive drum 1*a* in a state in which the developer fed to the developing portion is carried on the developing sleeve 28 in a magnetic chain state and a free end portion of the magnetic chain is contacted to the photosensitive drum 1*a*.

The developing sleeve 28 is rotated at a speed of 300 rpm and has a diameter of 20 mm.

The photosensitive drum 1*a* is rotated at a speed of 120 rpm and has a diameter of 30 mm. An opposing distance (SD gap) at the developing portion between the developing sleeve 28 and the photosensitive drum 1 is about 400 μm.

The developing sleeve 28 is constituted by a non-magnetic material such as aluminum or stainless steel and inside the developing sleeve 28, a magnet roller 28*m* is provided non-rotatably. The developing sleeve 28 rotates in an arrow R4 direction, and carries the developer in the magnetic chain state after a layer thickness thereof is regulated by a regulating blade 29, so that the toner is deposited on the electrostatic image formed on the photosensitive drum 1 to develop the electrostatic image into the toner image.

On the developing container 22, a plate-shaped regulating blade 29 is mounted so that a free end thereof opposes the developing sleeve 28. The regulating blade 29 is constituted by a non-magnetic material 29*a* formed of aluminum in a plate shape and a magnetic member 29*b* such as an iron material, which are disposed opposed to a peripheral surface of the developing sleeve 28 with respect to a rotational axis direction.

By the gap (SD gap) between the regulating blade 29 and the developing sleeve 28, the layer thickness of the developer carried on the developing sleeve 28 is regulated, so that an amount of the developer fed to the developing portion is adjusted. The SD gap is set at 200-1000 μm, preferably at 300-700 μm. In this embodiment, the SD gap is set at 400 μm, so that a developer coating amount per unit area on the developing sleeve 28 is regulated at 30 mg/cm$^2$.

As shown in FIG. 3, the inside of the developing container 22 is partitioned by a partition wall 27 into the developing chamber 23 in an upper side and the stirring chamber 24 in a lower side. The developing chamber 23 and the stirring chamber 24 communicate with each other through an opening 12 in an upstream side of the developing chamber 23 and an opening 11 in a downstream side of the developing chamber 23 to constitute a circulation path of the developer (two-component developer) containing the toner and the carrier. The developer is circulated between the developing chamber 23 and the stirring chamber 24 through the openings 12 and 11 by rotating first and second screws 25 and 26.

In the developing chamber 23, the first screw 25 is provided. The first screw 25 is prepared by helically winding a screw blade 53 of 9 mm in outer diameter and 40 mm in pitch around a screw shaft 51 of 6 mm in shaft diameter. The first screw 25 is disposed at the bottom of the developing chamber 23 in parallel to the developing sleeve 28, and rotates in an arrow R25 direction to feed the developer in a rotational axis direction while supplying the developer from the developing chamber 23 onto the developing sleeve 28.

In the stirring chamber 24, the second screw 26 is provided. The second screw 25 is prepared by helically winding a screw blade 54 of 9 mm in outer diameter and 40 mm in pitch around a screw shaft 52 of 6 mm in shaft diameter. The second screw 26 is disposed at the bottom of the stirring chamber 24 in parallel to the first screw 25, and rotates in an arrow R26 direction opposite to the rotational direction of the first screw 25 to feed the developer in the stirring chamber 24 in a direction opposite to the developer feeding direction of the first screw 25.

As shown in FIG. 2, the developing sleeve 28 is directly connected to a first driving motor M1. The first driving motor M1 is a DC brushless motor, and a rotational speed thereof in a steady state during the image formation is 300 rpm.

The first screw 25 is directly connected to a second driving motor M2. The first screw 25 and the second screw 26 are connected by a gear mechanism of 1:1.07 in gear ratio. The second driving motor M2 is a DC brushless motor, and a rotational speed thereof in a steady state during the image formation is 700 rpm.

The developing device 4*a* is of a function-separation type in which a room (chamber) in which the developer is supplied to the developing sleeve 28 and a room (chamber) in which the developer is collected from the developing sleeve 28 are separated from each other. In the developing device 4*a* of the function-separation type, the developer low in density (concentration) of the toner collected from the developing sleeve 28 is not used again as it is being carried on the developing sleeve 28, and therefore a problem such as density non-uniformity of the fixed image due to the developer low in toner concentration does not readily generate.

(Two-Component Developer)

As shown in FIG. 2, the developing device 4*a* employs a two-component developing type using, as the developer, the developer in which the toner and the carrier are mixed. In the developing container 22, as the developer, the two-component developer containing the toner and the carrier is accommodated.

The toner contains colored resin particles which contain a binder resin, a colorant and another additive as desired and to which an external additive such as colloidal silica fine powder is externally added. The toner is a negatively chargeably polyester resin material. A volume-average particle size of the toner may preferably be 4 μm or more and 10 μm or less, more preferably 8 μm or less.

As a material for the carrier, e.g., surface-oxidized or surface-unoxidized metals such as iron, nickel, cobalt, manganese, chromium or rare earth, or alloys of these metals or oxide ferrite may suitably be used. A manufacturing method of these magnetic particles is not particularly limited. The carrier is 20-60 μm, preferably 30-50 μm in weight-average particle size. The carrier is $10^7$ μcm or more, preferably $10^8$ ωcm or more in resistivity. In Embodiment 1, the carrier of $10^8$ ωcm in resistivity was used.

The developing device 4*a* triboelectrically charges the toner and the carrier by feeding the developer in the circulation path the developing container 22 while stirring the developer by rotating the first screw 25 and the second screw 26. The developer in the developing container 22 is gradually lowered in charging performance thereof by continuously circulated while the carrier which is not consumed by the image formation is subjected to friction in the developing container 22. For this reason, a fresh carrier is supplied to the developing container, while a part of the fed developer is discharged through the discharge opening 40 provided in the developing chamber 23 by being caused to overflow the feeding path through the discharge opening 40, so that an average charging performance of the carrier in the developer is ensured.

(Developer Supplying Portion)

As shown in FIG. 2, at an upper portion of the developing device 4*a*, a hopper 31 in which a supply developer in which the toner and the carrier are mixed is accommodated is provided. The supply developer is supplied from the hopper 31 into the developing device 4*a*, whereby the toner in an amount corresponding to an amount of the toner consumed by the image formation is supplied.

As shown in FIG. 3, the hopper 31 is provided with a screw-shaped supplying screw 32 at a lower portion thereof, and one end of the supplying screw 32 extends to a position of a developer supply opening 30 provided at a front end portion of the developing device 4*a*. The supply developer is supplied from the hopper 31 to the developing container 22 through the developer supplying opening 30 by a rotational force of the supplying screw 32 and gravitation of the supply developer. A supply amount of the supply developer is determined roughly by the number of turns of the supplying screw 32 as a feeding member, but this number of turns is determined by an unshown toner supply amount controller. The toner supply amount is obtained by optically or magnetically detecting the toner concentration of the two-component developer. The toner supply amount may also be obtained by forming a path toner image through development of a reference image on the photosensitive drum 1*a* and then by detecting the density of the patch toner image.

(Developer Discharge Opening)

As shown in FIG. 3, when the supply developer containing the carrier is supplied from the hopper 31, the developer circulating in the developer container 22 increases and overflows the feeding path through the discharge opening 40, thus being discharged from the developer container 22. The discharge opening 40 is provided screw of the developer carrying region of the developing sleeve 28 in the developing chamber 23. When the developer in the developing device 4*a* is increased by the supply of the supply developer, depending on an increase amount, the developer is discharged so as to overflow the feeding path through the discharge opening 40.

In this embodiment, a center position of the discharge opening 40 with respect to the developer feeding direction is downstream from an end of the developing sleeve 28 by 70 mm and is upstream from an upstream end of the opening 11 by 15 mm with respect to the developer feeding direction.

(Rib)

Figure 4:
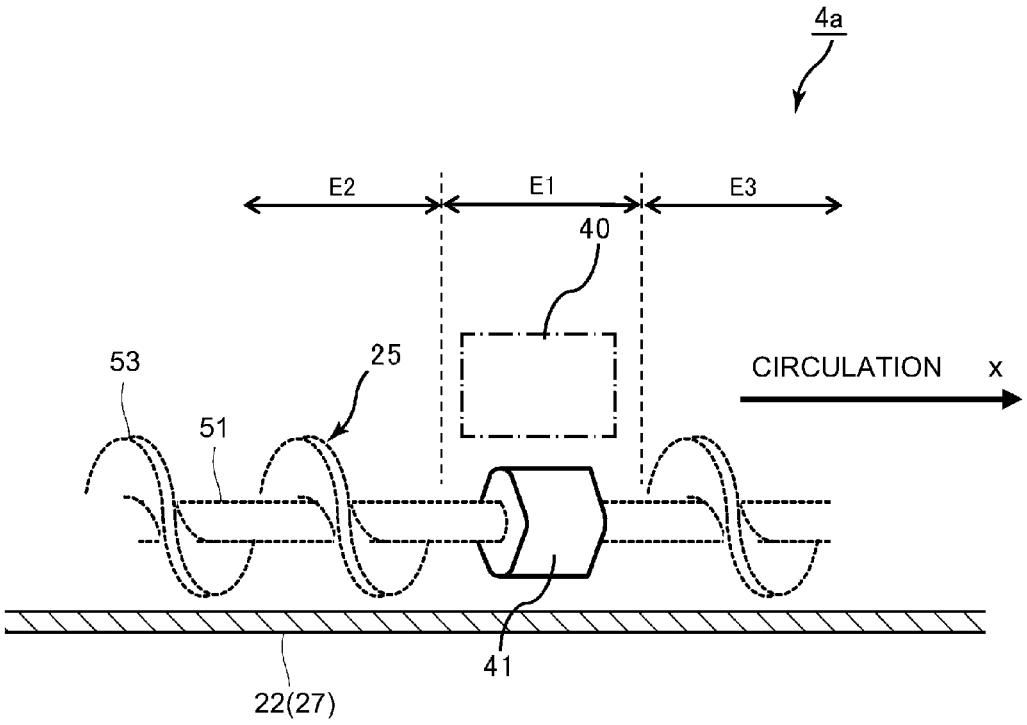
FIG. 4 is an illustration of arrangement of a rib with respect to a developer feeding direction.
Figure 5:
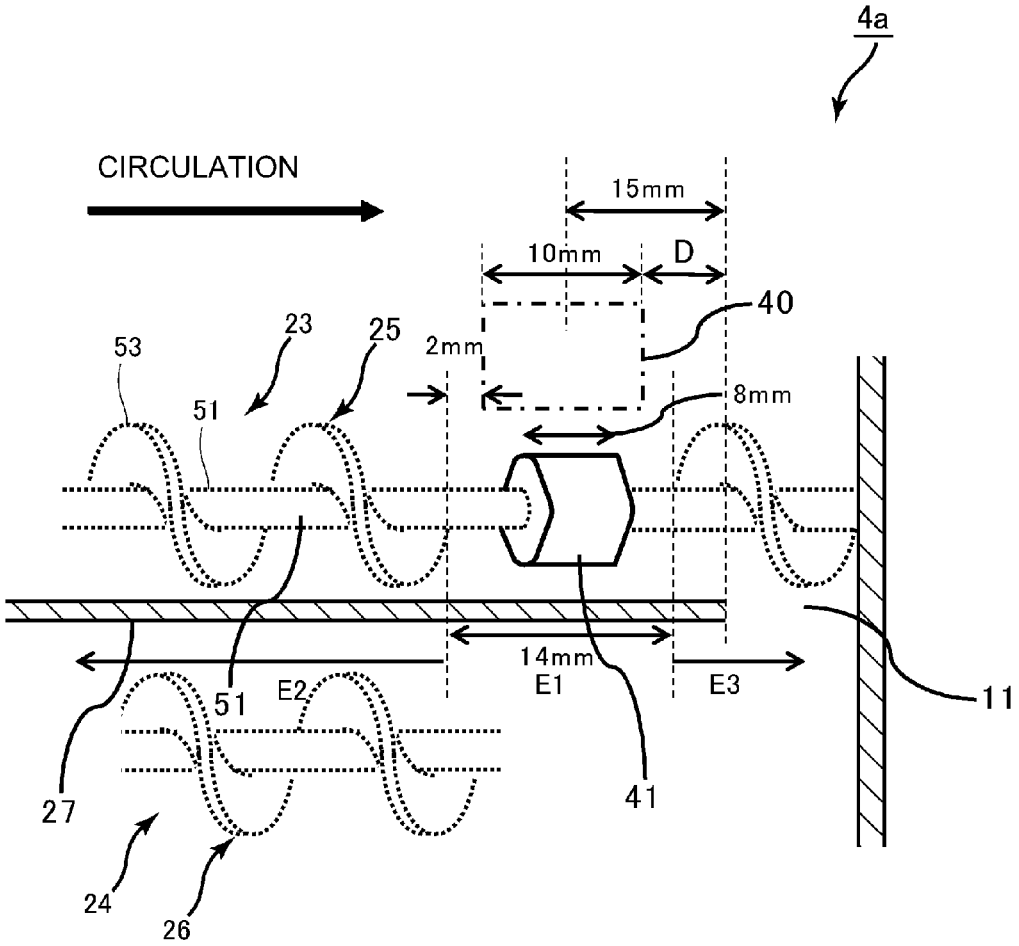
FIG. 5 is an illustration of arrangement of a discharge opening and a downstream opening with respect to the developer feeding direction.
Figure 6:
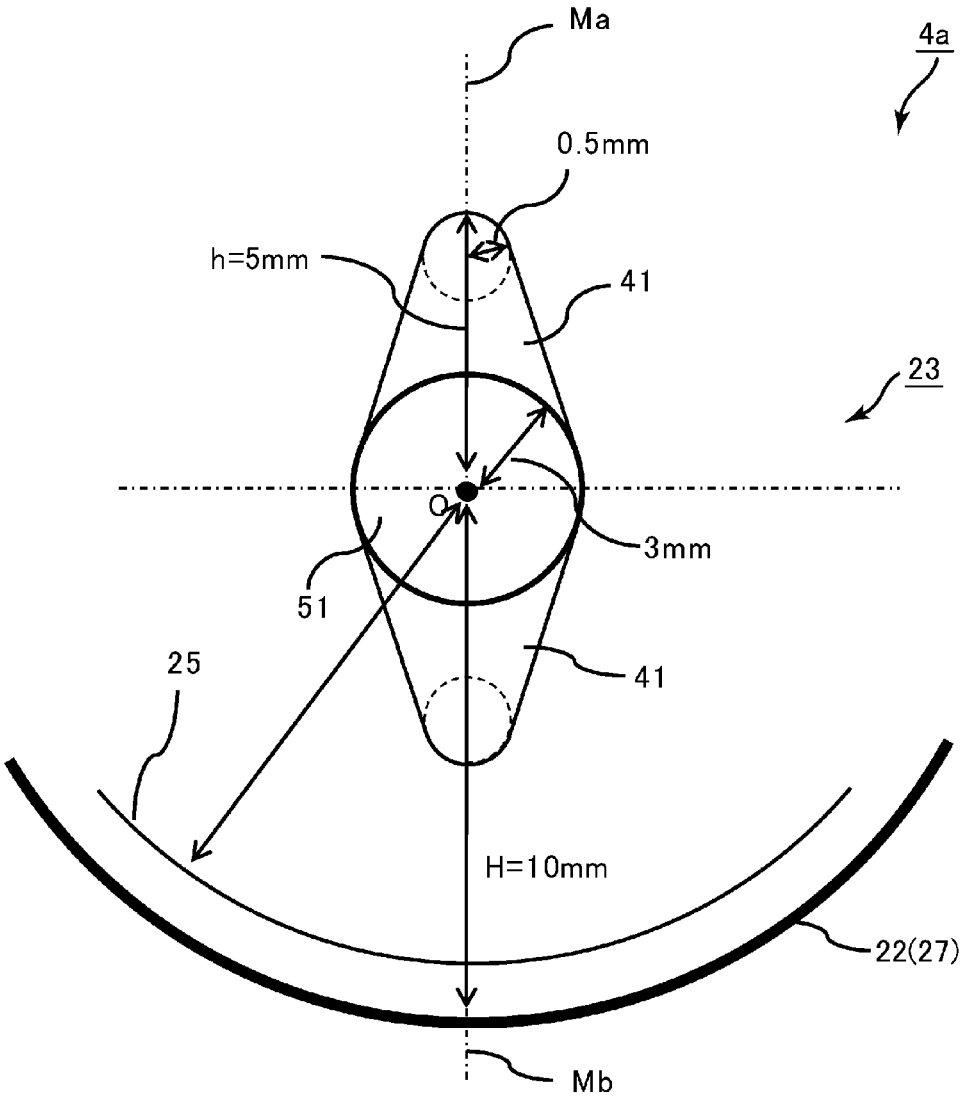
FIG. 6 is an illustration of the rib in an axially vertical cross section.

FIG. 4 is an illustration of arrangement of a rib with respect to the developer feeding direction. FIG. 5 is an illustration of arrangement of the discharge opening and the opening with respect to the developer feeding direction. FIG. 6 is an illustration of the rib in an axially vertical cross section.

As shown in FIG. 4, the first screw 25 has no screw blade in a first region E1 along the discharge opening 40 with respect to the developer feeding direction. Therefore, the first screw 25 in the first region E1 is smaller in force acting on the developer in circumferential direction or an outwardly radial direction than that of the first screw 25 in a second region E2. By removing the screw blade from the first region E1, jumping of the developer in the first region E1 by the first screw 25 is suppressed, so that only an actually excessive developer is developing sleeved through the discharge opening 40.

As shown in FIG. 4, the first screw 25 is, in addition of the removal of the screw blade from the first region E1 along the discharge opening 40, provided locally in the first region E1 with a rib 41 for stirring or vibrating the developer in the region along the developer discharge opening with rotation of the first screw 25. The rib 41 for vibrating the developer is disposed on the first screw 25 in the first region E1.

The rib 41 vibrates the developer in the first region E1 along the discharge opening 40, and therefore even in a constitution in which the screw blade in the region opposing the discharge opening 40 is omitted, it is possible to stably discharge the developer by the vibration independently of flowability of the developer.

With respect to the developer feeding direction, a center line of the first region E1 is aligned with a center line of the discharge opening 40 and a center line of the rib 41. With respect to the developer feeding direction, a length of the discharge opening 40 is 10 mm, a length of the first region E1 is 14 mm which is wider than the length of the discharge opening 40 by 2 mm in each of upstream and downstream sides of the discharge opening 40, and a length of the rib 41 is 8 mm.

As shown in FIG. 5, the developing device 4*a* stagnates the developer in the first region E1 by omitting the screw blade in the first region E1 along the discharge opening 40, thus stagnating the developer in the first region E1 and realizing stable discharge of the developer in a leveling manner through the discharge opening 40.

As shown in FIG. 6, the screw shaft 51 is provided at a position of a height H=10 mm from the bottom (an upper surface of the partition wall 27) of the developing chamber 23. The rib 41 has a substantially elliptical cross-sectional shape in the axially vertical cross section. The shape of the rib 41 in the axially vertical cross section is such a shape that the rib 41 narrows from the screw shaft 51 toward a free end along a tangential line of the screw shaft 51, and a free end portion of the rib 41 has a semicircular shape of 0.5 mm in radius. A height h of the rib 41 is 5 mm smaller than an outer diameter of the first screw 25.

The rib 41 is fixed on the first screw 25. The rib 41 includes a pair of portions divided by the screw shaft 51. A contour of the rib 41 is symmetrical with respect to a rectilinear line Ma-Mb passing through a center O of the screw shaft 51.

The rib 41 vibrates and loosens the developer passing below the portion 40 with the rotation of the first screw 25 to level the developer surface, so that a local raising of the developer surface is eliminated. As a result, overflow of the developer through the discharge opening 40 in a collective manner is prevented, so that the discharge of the developer through the discharge opening 40 is stabilized.

As described above, the developing sleeve 28 which is an example of a developer carrying member includes the carrying region for the developer containing the toner and the carrier. The developing chamber 23 and the stirring chamber 24 which are examples of a first feeding path and a second feeding path, respectively, are disposed along the developing sleeve 28, and communicate with each other at their end portions through the openings 11 and 12 which are examples of a first opening and a second opening, respectively, thereby to form a circulation path of the developer. The first screw 25 which is an example of a first screw member includes the screw blade and rotates in the developing chamber 23, and supplies the developer to the developing sleeve 28 while feeding the developer delivered from the stirring chamber 24 through the opening 12. The second screw 26 which is an example of a second screw member includes the screw blade and rotates in the stirring chamber 24, and feeds the developer delivered from the developing chamber 23 through the opening 11 and the developer collected from the developer carrying region. A discharging portion Ha which is an example of a discharging portion is capable of discharging a part of the developer in the developing chamber 23 in an overflow manner through the discharge opening 40 provided in the first region E1 between the carrying region and the opening 11 in the developing chamber 23.

The first screw 25 in the first region E1 has no screw blade or has the screw blade smaller in diameter than those in the second region E2 upstream of the first region E1 and a third region E3 downstream of the first region E1 with respect to the developer feeding direction.

(Reduction in Cross-Sectional Area of Opening)

As shown in FIG. 3, in the stirring chamber 24, during an operation of the developing device 4*a*, the developer from the developing sleeve 28 is merged little by little with the developer in the stirring chamber 24, and therefore the amount of the fed developer increases toward the downstream end portion of the stirring chamber 24. For this reason, the opening 12 provided at the downstream end portion of the stirring chamber 24 (i.e., the upstream end portion of the developing chamber 23) is large correspondingly to a developing performance of the developing device 24*a*. The opening 12 is 40 mm in longitudinal length, 20 mm in depth and 800 $mm^2$ in cross-sectional area.

On the other hand, in the developing chamber 23, the developer fed in the developing chamber 23 with the feeding of the developer is gradually carried on the developing sleeve 28 and is fed to the stirring chamber 24, and therefore, the amount of the fed developer decreases toward the downstream end portion of the developing chamber 23. For that reason, the amount of the developer which reaches the opening 11 positioned at the downstream end portion of the developing chamber 23 and which is then delivered to the stirring chamber 24 becomes small, and therefore the downstream opening 11 may be small compared with the opening 12.

A flow amount J(x) of the developer is minimum at the opening 11 and maximum at the opening 12, and therefore the opening 11 can be made smaller in cross-sectional area than the opening 12. This is a large advantage and feature of the function-separation type. By decreasing the size of the opening 11, as shown in FIG. 3, the length of the developing device 4*a* with respect to a rotational axis direction of the developing device 4*a* decreases, so that it is possible to achieve downsizing of the developing device 4*a* without impairing a developing performance. The opening 11 is 15 mm in longitudinal length, 15 mm in depth and 225 $mm^2$ in cross-sectional area which is merely about ¼ of the cross-sectional area of the opening 12.

However, the decrease in size of the opening 11 is important to achieve the downsizing of the developing device 4*a* in a longitudinal direction of the developing device 4*a*, and on the other hand, when the size of the opening 11 is made excessively small, the developer stagnates at the opening 11, and has the influence on the discharge of the developer through the discharge opening 40.

Particularly, in the case where the distance between the discharge opening 40 and the opening 11 is relatively small and the screw blade is omitted in the first region E1 along the discharge opening 40, the influence on the discharge of the developer at the discharge opening 40 is more conspicuous. In general, in the case where the screw blade is downsized or omitted to stagnate the developer in the first region E1 and then the developer is discharged through the discharge opening 40, as the discharge opening 40 is closer to the opening 11, the influence of developer pressure at the opening 11 is liable to be exerted on the developer surface in the first region E1.

Further, as shown in FIG. 5, in the case where a distance D from the downstream end of the discharge opening 40 to the upstream end of the opening 11 with respect to the developer feeding direction is smaller than one pitch of the first screw 25, the above influence is further conspicuous. The screw blade holds and feeds the developer by the blade of one pitch, and therefore the developer cannot be fed sufficiently when the distance D is less than one pitch, so that the developer is liable to be affected by the developer pressure at the opening 11. In this embodiment, D=10 mm and therefore is smaller than one pitch, i.e., 40 mm of the first screw 25.

For that reason, in this embodiment, the developer pressure at the opening 11 is liable to have the influence on the developer below the discharge opening 40, so that the developer pressure from the opening 11 is liable to fluctuate the developer surface in the first region E1. When the developer surface in the first region E1 fluctuates, the discharges of the developer through the discharge opening 40 is liable to become unstable, so that a degree of a fluctuation in amount of the developer in the developing device 4*a* becomes large.

When the developer surface in the first region E1 along the discharge opening 40 is raised, even in the case where the developer should not be discharged, collective developer discharge generates. When unnecessary developer discharge is made, the amount of the developer in the developing device 4*a* is below the developer amount necessary to stably circulate the developer, so that there is a possibility that the decreased developer amount leads to a problem that the developer is not sufficiently supplied to the developing sleeve 28.

Therefore in Embodiment 1, parameters in the neighborhood of the opening 11 are optimized, so that the fluctuation in developer surface in the first region E1 is suppressed.

(Parameters in the Neighborhood of Opening)

Figure 7:
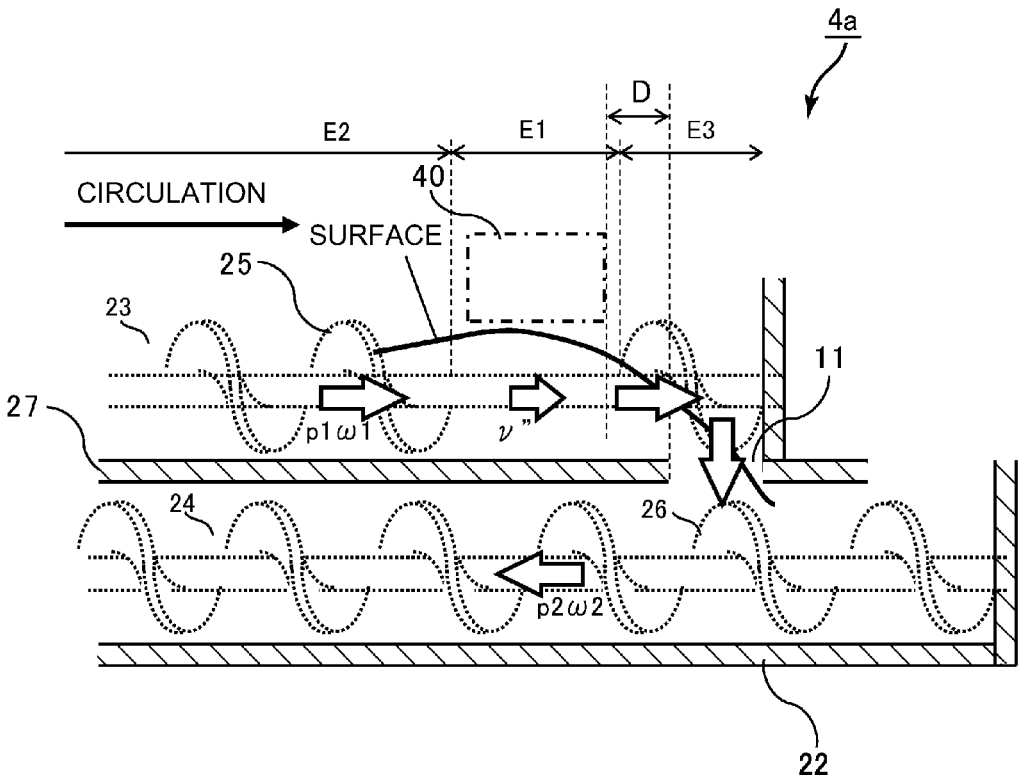
FIG. 7 is an illustration of a developer surface in a developing chamber when a developer does not stagnate.
Figure 8:
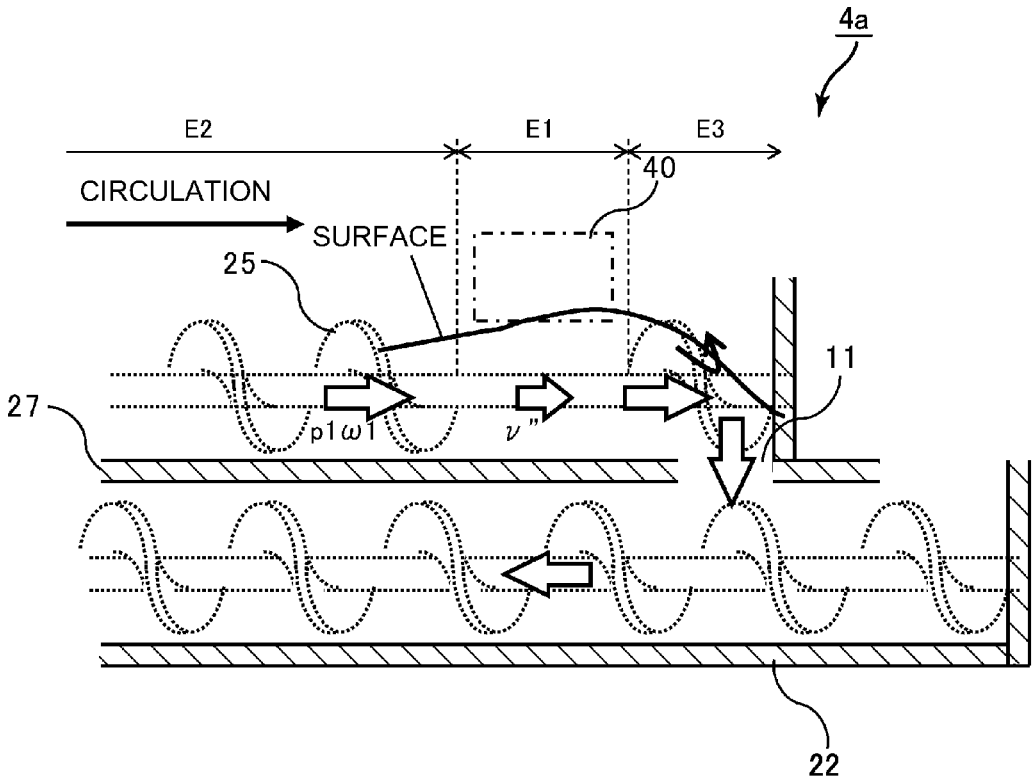
FIG. 8 is an illustration of the developer surface in the developing chamber when the developer stagnates.
Figure 9:
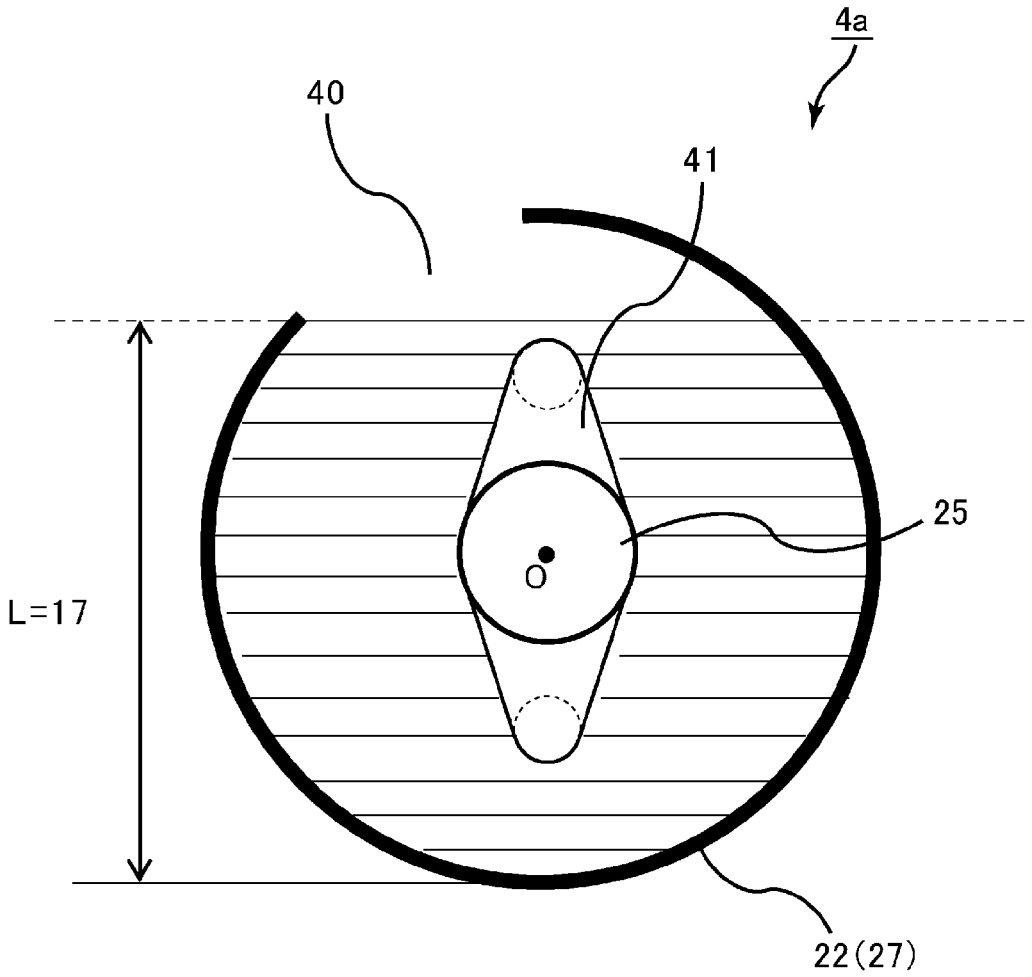
FIG. 9 is an illustration of a cross-sectional area of the developer flowing along a discharge opening.
Figure 10:
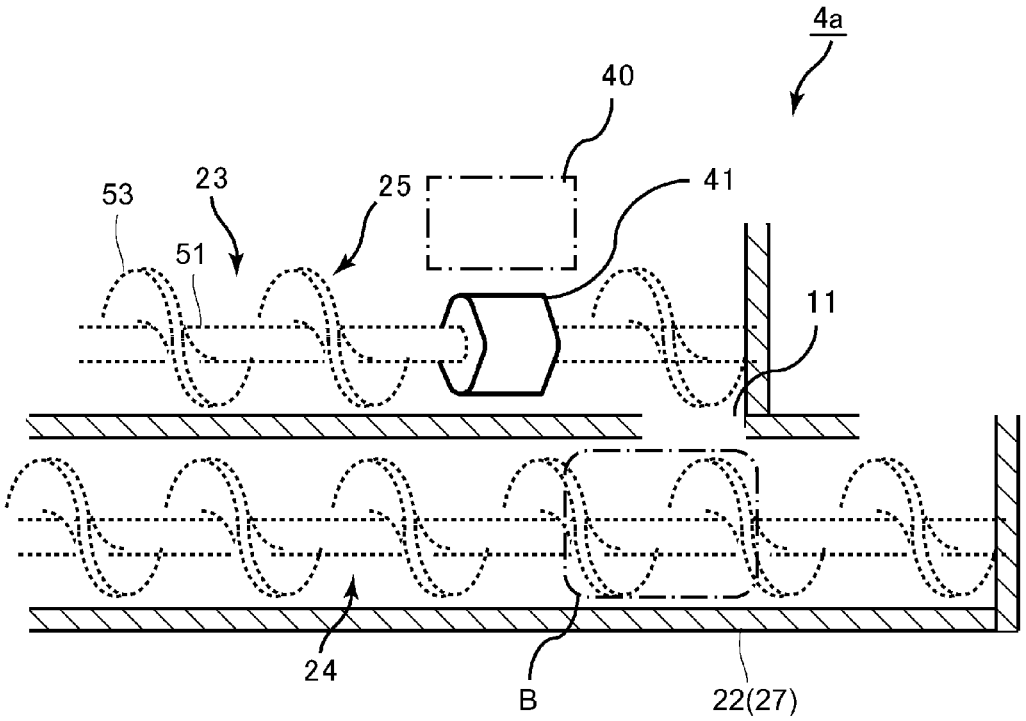
FIG. 10 is an illustration of a flow of the developer in a stirring chamber at a position immediately under the downstream opening.

FIG. 7 is an illustration of the developer surface in the developing chamber in the case where the developer does not stagnate. FIG. 8 is an illustration of the developer surface in the developing chamber in the case where the developer stagnates. FIG. 9 is an illustration of a cross-sectional area of the developer passing along the discharge opening. FIG. 10 is an illustration of a flow of the developer in the stirring chamber at a position immediately under the opening.

As shown in FIG. 7, when a cross-sectional area of the developer at a longitudinal position x of the developing chamber 23 is S(x) and a circulation speed of the developer is v(x), a volume flow amount J(x) of the developer at the position x is obtained by the following equation.

$$J(x)=S(x)v(x)$$

In this case, the circulation speed v(x) of the developer is roughly constant independently of the position x except for the region E1 along the discharge opening 40. When a screw pitch of the first screw 25 is p and a rotational speed of the first screw 25 is ω(rps), the circulation speed v(x) is obtained by the following equation.

$$v(x)=p\Omega$$

Accordingly, the volume flow amount J(x) of the developer at the position x of the developing chamber 23 is modified as follows.

$$J(x)=S(x)p\omega$$

After the developing device 4*a* is actuated, when the developer is in a steady state, the amount of the developer approaching the position x and the amount of the developer moving away from the position x are equal to each other, so that even at any position x, the flow amount J(x) for each position x is uncharged.

$$\nabla J(x)=0$$

As described above, the volume flow amount J(x) of the developer at the position x of the developing chamber 23 becomes smaller with the position x closer to the downstream end. Then, after the position x passed through the downstream end of the developing sleeve 28, a part of the developer is discharged through the discharge opening 40 and is further decreased in amount, and when the position x passed through the downstream end of the discharge opening 40, the amount becomes constant, so that the developer flows into the stirring chamber 24 through the opening 11 as it is.

As shown in FIG. 8, when the developer in an amount not less than the flow amount in which the developer is capable of passing through the opening 11 is supplied, the developer which cannot pass through the opening 11 stagnates and raises the developer surface on the opening 11. The developer stagnates at the opening 11 when the developer is supplied through the opening 11 in an amount not less than a tolerable amount with respect to the opening area of the opening 11.

The developer in the developing chamber 23 is fed at a certain speed v1 until the developer reaches the first region E1 along the discharge opening 40.

$$v1=p1\omega1$$

In the first region E1 along the discharge opening 40, the screw blade is removed, and therefore the speed v1 decreases and the developer stagnates, and then when the developer passed through the first region E1, the developer is fed at the certain speed v1. At the downstream opening 11, there is no member which decreases the speed of the developer, and therefore the developer passes through the opening 11 at the speed v1. At this time, a maximum volume flow amount of the developer capable of passing through the opening 11 is J'max. The maximum volume flow amount J'max is obtained by the following equation using a speed v' at which the developer passes through the opening 11 and a cross-sectional area S' of the opening 11.

$$J'\text{max}=S'v'=S'p1\omega1$$

The cross-sectional area of the developer at the opening 11 is not the cross-sectional area S' or more, and therefore the developer having the cross-sectional area S' or more cannot pass through the opening 11 by forcedly increasing the speed v'. In these cases, by reaction thereof, there is a possibility of generation of stagnation as shown in FIG. 8. When the developer passes through the opening 11, in order to prevent the stagnation of the developer, there is a need that the volume flow amount of the developer flowing into the opening 11 is J'max or less.

$$J'\text{max}=S'v'=S'v1$$

On the other hand, the discharge opening 40 is positioned between the downstream end of the developing sleeve 28 and the opening 11, so that a part of the developer which has not been supplied to the developing sleeve 28 is discharged through the opening 11. As shown in FIG. 9, the lower end of the discharge opening 40 is in a position of a height L=17 mm from the bottom of the developing container 22, and the developer running over the lower end of the discharge opening 40 is discharged through the discharge opening 40.

For this reason, a maximum volume flow amount of the developer which runs over the lower end of the discharge opening 40 and which is fed through the discharge opening 11 is a maximum volume flow amount J"max after passing of the developer through the discharge opening 40. The maximum volume flow amount J" max of the developer capable of passing through the discharge opening 40 is represented by the product of a flow path cross-sectional area R" of the first region E1 along the discharge opening 40 and a speed v" of the developer passing through the first region E1.

$$J''\text{max}=R''v''$$

The flow path cross-sectional area R" is, as shown in FIG. 9, a volume obtained by subtracting a cross-sectional area of the first screw 25 in a region of a height L or less from a cross-sectional area of the developer container 22 in a region not higher than the lower end of the discharge opening 40 having the height L. The flow path cross-sectional area R" is the cross-sectional area when the developer is fed in a largest amount without being discharged through the discharge opening 40.

Further, as shown in FIG. 7, the developer stagnates in the first region E1 along the discharge opening 40, and therefore the speed v" of the developer when the developer passes through the first region E1 is smaller than the speed v1 of the developer in the second region E2 where the screw blade is not removed. When a ratio α of the developer speed v" in the first region E1 to the developer speed v1 in the second region E2 ($0<\alpha<1$) is defined as deceleration, the developer speed v" in the first region E1 is represented by the following equation:

$$v''=\alpha v1=\alpha p1\omega1.$$

Further, the maximum volume flow amount J"max of the developer capable of passing through the first region E1 at the developer speed v" is represented by the following equation:

$$J''\text{max}=R''\alpha v1.$$

In order to satisfactorily discharge the developer through the discharge opening 40 without causing the stagnation of the developer at the opening 11, there is a need to satisfy the following formula:

$$J''\text{max}\leq J'\text{max}.$$

When this relationship holds, it would be considered that the developer does not stagnate at the opening 11, and therefore the above formula is modified to derive the following relationship:

$$J''\text{max}=R''\alpha p1\omega1\leq J'\text{max}=S'p1\omega1.$$

Accordingly, in order to satisfactorily discharge the developer through the discharge opening 40 without causing the stagnation of the developer at the opening 11, there is need to satisfy the following relationship:

$$R''\alpha\leq S'.$$

Further, just the same discussion also holds true for the stirring chamber 24 at the position immediately under the opening 11. As shown in FIG. 10, even in the case where the developer passed through the discharge opening 40 does not stagnate at the opening 11, when the stagnation of the developer generates in a region B immediately under the opening 11, the developer eventually stagnates at the opening 11 and finally has the influence on stability of the discharge of the developer through the discharge opening 40.

In order to prevent the developer from stagnating at the region B immediately under the opening 11, a flow amount J2 of the developer in the region B may only be required to be not more than a maximum volume flow amount J2max of the developer fed from the region B toward the downstream end of the stirring chamber 24. As shown in FIG. 10, the maximum developer flow amount J2max in the stirring chamber 24 which is an example of a second feeding path is defined in the region B which is an example of a region downstream of the opening 11 which is an example of a second opening with respect to the developer circulation direction. The region B is a region of one pitch of the second screw 26 opposing the opening 11. A relationship of J2≤J2max is represented by the following relationship when a flow path cross-sectional area of the stirring chamber 24 at a downstream end position of the opening 11 is R2, a cross-sectional area of the developer in R2 is S2, a pitch of the second screw 26 is p2, and a rotational speed of the second screw 26 is ω2.

$$J2=S2v2=S2p2\omega2\leq J2\max=R2p2\omega2$$

The maximum volume flow amount J"max of the developer capable of passing through the first region E1 is J"max=R"αv1=R"αp1ω1, and therefore the following relationship is derived from the relationship of J"max≤J2max.

$$R''\alpha p1\omega1\leq R2p2\omega2$$

$$R''\alpha p1\omega1/p2\omega2\leq R2$$

That is, in order to realize stable developer discharge through the discharge opening 40 while preventing the stagnation of the developer at the opening 11 or in the region B immediately under the opening 11, the following relationships may only be required to hold.

$$R''\alpha\leq S \qquad \text{(condition 1')}$$

$$R''\alpha p1\omega1/p2\omega2<R2 \qquad \text{(condition 2')}$$

In the case where the cross-sectional area S' of the opening 11 and the flow path cross-sectional area R2 of the region B immediately under the opening 11 are remarkably large, the conditions 1' and 2' are sufficiently satisfied, so that it would be considered that the stagnation of the developer does not generate.

However, when the flow path cross-sectional area R2 of the region B is remarkably increased, the downsizing of the developing device which is the advantage of the developing device of the function-separation type cannot be realized. Further, from the viewpoint of the downsizing of the developing device, the cross-sectional area S' of the opening 11 may preferably be small and may preferably exceed R" at the maximum.

$$S'\leq R''$$

$$R2\leq R''p1\omega1/p2\omega2$$

As a condition 1, S'<R" is satisfied.

In the above, calculation was made assuming that the pitch of the screw blade of the first screw 25 in each of the first region E1 and the third region 23 is the same, i.e., p1. However, in general, on condition that the pitch of the screw blade of the first screw 25 in the third region E3 is p1', the following relationships hold.

$$R''\alpha p1/p1'\leq S'$$

$$S'\leq R''p1/p1' \qquad \text{(condition 1'')}$$

From the above, both downsizing of the developing device and stable discharge of the developer through the discharge opening 40 can be realized by preventing the stagnation of the developer at the opening 11 or the region B under the opening 11.

$$R''\alpha p1/p1'\leq S'\leq R''p1/p1' \qquad \text{(condition 1)}$$

$$R''\alpha p1\omega1/p2\omega2\leq R2\leq R''p1\omega1/p2\omega2 \qquad \text{(condition 2)}$$

In the case where the screw blade pitch of the first screw 25 is each of the first region E1 and the third region E3 shown in FIG. 5 is the same, i.e., p1, the condition 1 including p1' is modified as follows, but the condition 2 which does not include p1' remains unchanged.

$$R''\alpha\leq S'\leq R'' \qquad \text{(condition 1)}$$

$$R''\alpha p1\omega1/p2\omega2\leq R2\leq R'p1\omega1/p2\omega2 \qquad \text{(condition 2)}$$

(Measuring Method of Deceleration)

An experiment using a high-speed camera was conducted in the following procedure, so that a deceleration (speed radiation ratio) α was obtained by measuring developer moving speeds in the second region E2 and the first region E1.

(1) The developing device 4*a* was fixed to a jig capable of driving the developing device 4*a* similarly as in an actual machine, and the high-speed camera was disposed at a position substantially perpendicular to the discharge opening 40.

(2) The developer was charged in the developing device 4*a* in an amount enough to coat the entire region of the developing sleeve 28, and the developing device 4*a* was operated with a setting similar to that for the actual machine.

(3) Phototaking of the first region E1 with the high-speed camera was made at a frame rate to the extent that an agglomeration of the developer was satisfactorily recognizable. Specifically, the phototaking was made for 1 sec at a resolution of 1024×1024 and at a frame rate of 2000 fps by using the high-speed camera ("FASTCAM-SA4", manufactured by Photron Limited). The image was dark when the frame rate was increased, and therefore a xenon light source (manufactured by Kenko Tokina Corp.) was used as a shooting light source.

(4) At each of frames of the image taken, the number of pixels moving on the image in the developer circulation direction (the longitudinal direction in this embodiment) was obtained. Comparison of the image is not required to be made every frame, but may also be made every 100 frames if the taken image can follow the developer. The following of the developer may also be made by eye observation or by darkness (density level) obtained by converting the image into density. At this time, a scale was also taken together with the image so that an actual size of one pixel is visually recognized on the taken image.

(5) The developer moving speed v" in the first region E1 was obtained by dividing a movement amount of the developer obtained in (4) by a lapse of time obtained from the number of image intervals and the frame rate. By dividing the speed v" by the moving speed pω of the screw blade of the first screw 25, the deceleration α with respect to the developer amount at that time was obtained.

(6) The amount of the developer charged in the developing device 4*a* was changed, and then the experiment was repeated by the procedure of (1) to (5) described above, so that values of the deceleration α with respect to various developer amounts were obtained.

(7) Of the values of the deceleration α with respect to the various developer amount, a largest value (i.e., the smallest reduced speed) is defined as the deceleration α in the present invention.

The developer amount set in (6) was set as follows. That is, the developer amount when a whole surface white background image (solid white image) was continuously outputted was a minimum value of an amplitude of the developer amount in (7). Further, the developer amount when a whole surface maximum density image (solid black image) was continuously outputted was a maximum value of the amplitude of the developer amount in (7). This is because the former is a minimum developer amount of the developing device 4*a* and the latter is a maximum developer amount of the developing device 4*a*. That is, the deceleration α was obtained in a range of the developer amount which can be obtained in the developing device 4*a* in actual image formation.

(Result of Processing of Conditions 1 and 2)

By the procedure (1) to (7) described above, the deceleration α of the developer passing through the first region E1 along the discharge opening 40 was obtained, and then the maximum value of the developer speed v" in the first region E1 was calculated. From the maximum value of the developer speed v", the maximum volume flow amount J"max of the developer after passing through the discharge opening 40 was calculated.

As a result, the deceleration α was about 0.7. At the deceleration α=0.7, the conditions 1 and 2 were calculated.

$R''$=241 ($mm^2$) and $S'$=15×15=225 ($mm^2$), and therefore $R''\alpha \leq S'$ is surely satisfied. Condition 1:

$R2$=270 ($mm^2$), and therefore also $R2 \leq R''\alpha p1/\omega 1/p2\omega 2$ is surely satisfied. Condition 2:

(Comparison Experiment)

Figure 11:
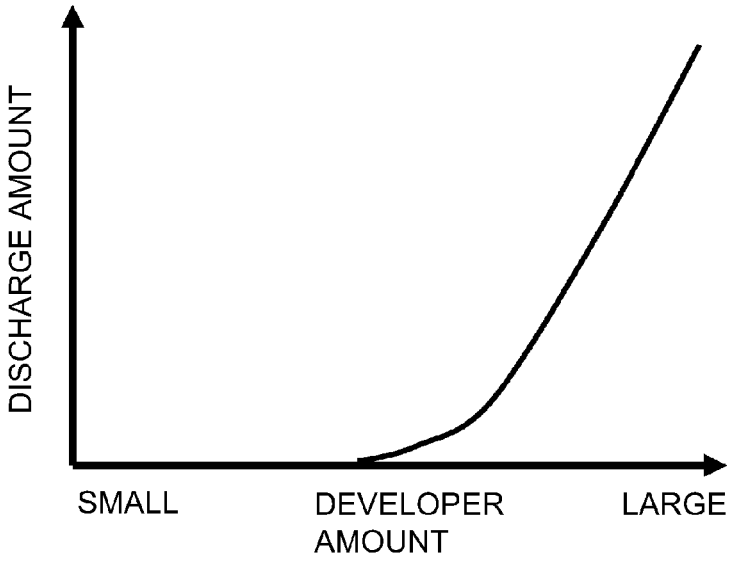
FIG. 11 is a graph showing a relationship between a developer amount and a developing sleeve amount in Embodiment 1.
Figure 12:
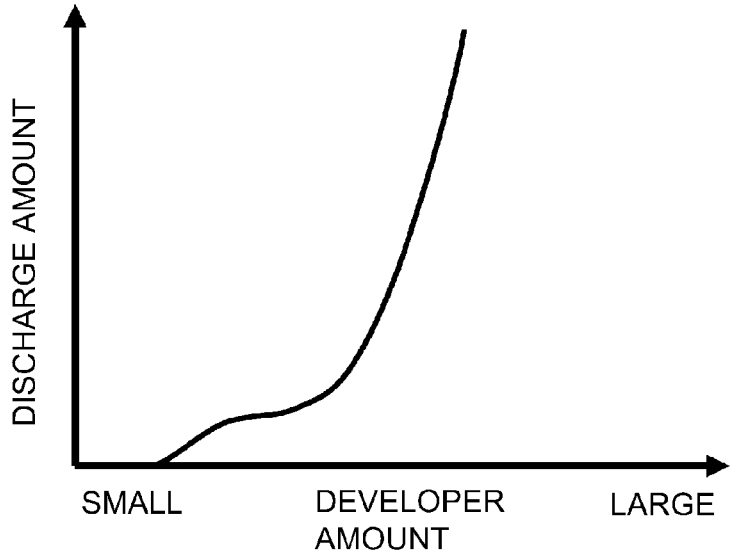
FIG. 12 is a graph showing a relationship between a developer amount and a discharge amount in a Comparison Example.

FIG. 11 is an illustration of a relationship between the developer amount and a discharge amount in Embodiment 1. FIG. 12 is an illustration of a relationship between the developer amount and a discharge amount in a Comparison Example. The relationship between the developer amount and the discharge amount of the developer discharged through the discharge opening was compared between the developing device in Embodiment 1 in which the conditions 1 and 2 were satisfied and a developing device in the Comparison Example in which the conditions 1 and 2 were not satisfied. The developing device in the Comparison Example is 10 mm, in longitudinal length of the opening 11, different from 15 mm in the developing device in Embodiment 1, and other constitutions are similar to those in Embodiment 1.

As shown in FIG. 3, in each of the developing device 4*a* in Embodiment 1 and the developing device in the Comparison Example, 300 g of the developer was charged and thereafter the developer amount was stepwise changed in an increment of 10 g and then each of the developing devices was operated under the same condition. The discharge amount of the developer discharged through the discharge opening 40 in a time of 30 sec from the start of the operation was measured. During the separation for 30 sec., the supply developer was not supplied into the developing device, and the developer through the discharge opening 40 was collected in a collecting container and was weighed.

Specifically, the measurement was performed by the following procedure.

In a state in which the developing sleeve, the first screw and the second screw are driven at a desired peripheral speed, the developer is placed in the developer container until the developer is uniformly coated on the developing sleeve. The developing sleeve, the first screw and the second screw are driven at the desired peripheral speed until the circulation of the developer in the developing container is in a steady state (1 or 2 minutes in general). Then, from the time when the coating of the developer on the developing sleeve becomes uniform, the remaining developer was gradually supplied into the developing container through the supply opening, and the discharge amount of the developer for 30 sec was measured. The developing sleeve amount of the developer for 30 sec was measured under each of conditions in which the developer was increased in the increment of 10 g.

As shown in FIG. 11, when the amount of the developer charged in the developing device 4*a* is increased, the discharge amount of the developer discharged through the discharge opening 40 for 30 sec after the start of the operation is increased. In Embodiment 1, compared with Comparison Example shown in FIG. 12, a developer discharge starting point shifts in a side where the developer amount is large, and therefore the developer in a sufficient amount is always circulated continuously in the developing device 4*a*. The developer surface having a sufficient height is ensured over the entire region in the developing chamber 23 along the developing sleeve 28, so that the developer in the sufficient amount can be coated over the entire developer carrying region of the developing sleeve 28. For this reason, stable image formation can be effected with no image defect for a long time while satisfying the downsizing of the developing device.

As shown in FIG. 12, in the Comparison Example, the developer amount in which the discharge amount of the developer through the discharge opening 40 really starts an increase shifts in a side where the developer amount is small, compared with Embodiment 1 shown in Embodiment 1. That is, even in the developer amount in which the developer should not be discharged originally, the developer is discharged from the developing device through the discharge opening 40, and therefore when the operation for a long time is continued, the amount of the developer circulating in the developing device gradually becomes insufficient. For this reason, in the Comparison Example, the developer surface in the developing chamber 23 lowers, and the sufficient supply of the developer is not made in the downstream side of the developer carrying region of the developing sleeve 28, so that the image defect such as improper developer coating is liable to generate.

(Effect of Embodiment 1)

As described above, in Embodiment 1, the ratio of the developer feeding speed in the first region E1 to the developer feeding speed in the second region E2 is α. The screw blade pitch of the first screw 25 in the second region E2 is p1. The screw blade pitch of the first screw 25 in the third region E3 is p1'. The rotational speed of the first screw 25 is ω1. The maximum value of the cross-sectional area of the developer in a region lower than the lower end of the discharge opening 40 in the axially vertical cross section including the discharge opening 40 in the developing chamber 23 is R. The minimum value of the cross-sectional area of the stirring chamber 24 in the axially vertical cross section at the position downstream of the opening 11 with respect to the developer circulation direction is R2. The screw blade pitch of the second screw 26 at the position downstream of the opening 11 with respect to the developer circulation direction is p2. The rotational speed of the second screw is ω2. The opening area of the opening 11 is S'.

In this case, the relationships of $R''\alpha p1/p1' \leq S' \leq R''p1/p1'$ and $R''\alpha p1\omega 1 \leq R2p2\omega 2 \leq R''p1\omega 1$ hold. For this reason, it is possible to stably operate the developing device 4*a* with high performance by avoiding excessive discharge of the developer through the discharge opening 40 while downsizing the developing device 4*a* by reducing the area of the opening 11.

In Embodiment 1, the maximum toner flow amount in the first region E1 is J"max. The maximum toner flow amount of the toner passing through the opening 11 is J'max. The maximum toner flow amount of the toner in the stirring chamber 24 at the position downstream of the opening 11 with respect to the developer circulation direction is J2max. The maximum value of the cross-sectional area of the developer in a region lower than the lower end of the discharge opening 40 in the axially vertical cross section including the discharge opening 40 in the developing chamber 26 is R".

In this case, the relationships of J"max≤J'max≤J2max and S'<R" hold. For this reason, it is possible to stably operate the developing device 4*a* with high performance by avoiding excessive discharge of the developer through the discharge opening 40 while downsizing the developing device 4*a* by reducing the area of the opening 11.

In Embodiment 1, the relationship of p1≤p1' holds. For this reason, the developing device 4*a* can be further downsized by further decreasing the opening 11.

In Embodiment 1, the developer supply opening 30 which is an example of a supplying portion for supplying the supply developer containing the toner and the carrier toward the side upstream of the opening 11 with respect to the developer circulation direction in the stirring chamber 24 with the image formation is provided. For this reason, it is possible to achieve the high performance of the developing device 4*a* by sufficiently mixing the supply developer with the circulating developer.

In Embodiment 1, the first screw 25 in the first region E1 includes the projection having the inclination angle, with respect to the rotational axis direction, smaller than that of the screw blade of the first screw 25 in the second region E2. For this reason, the developer in the region below the portion 40 is properly stirred, so that it is possible to stabilize the stagnation of the developer in the first discharge E1 and the discharge of the developer through the discharge opening 40.

In Embodiment 1, the screw blade of the first screw 25 in the third region E3 ranges one pitch or more. For this reason, the developer can be stably delivered from the first region E1 over one rotation of the first screw 25.

In Embodiment 1, the amount of the developer moving from the developing chamber 23 to the stirring chamber 24 without via the developing sleeve 28 is remarkably smaller than the amount of the developer moving from the stirring chamber 24 to the developing chamber 23. For this reason, compared with the flow path along which the developer moves from the stirring chamber 24 to the developing chamber 23, the flow path along which the developer moves from the developing chamber 23 to the stirring chamber 24 is made small, so that the downsizing of the developing device 4*a* can be achieved.

In Embodiment 1, in the developing device 4*a* of the function-separation type, the stagnation of the developer at the communication portion from the developing chamber 23 to the stirring chamber 24 can be prevented, so that it is possible to achieve the downsizing of the developing device 4*a* while maintaining stability of the discharge of the developer.

Modified Embodiments

Figure 13:
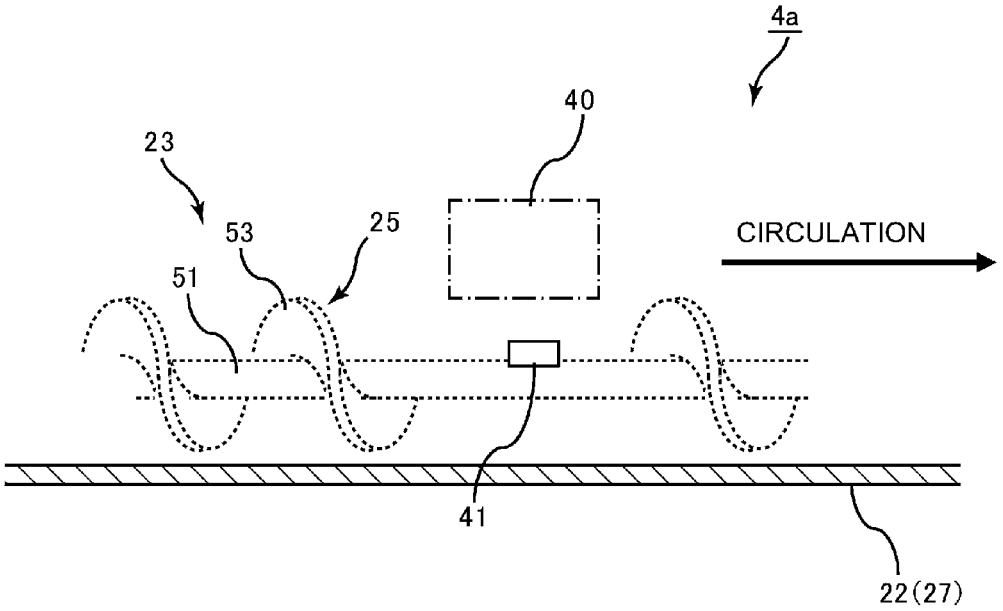
FIG. 13 is an illustration of a rib shape in a developing device in Modified Embodiment 1.
Figure 14:
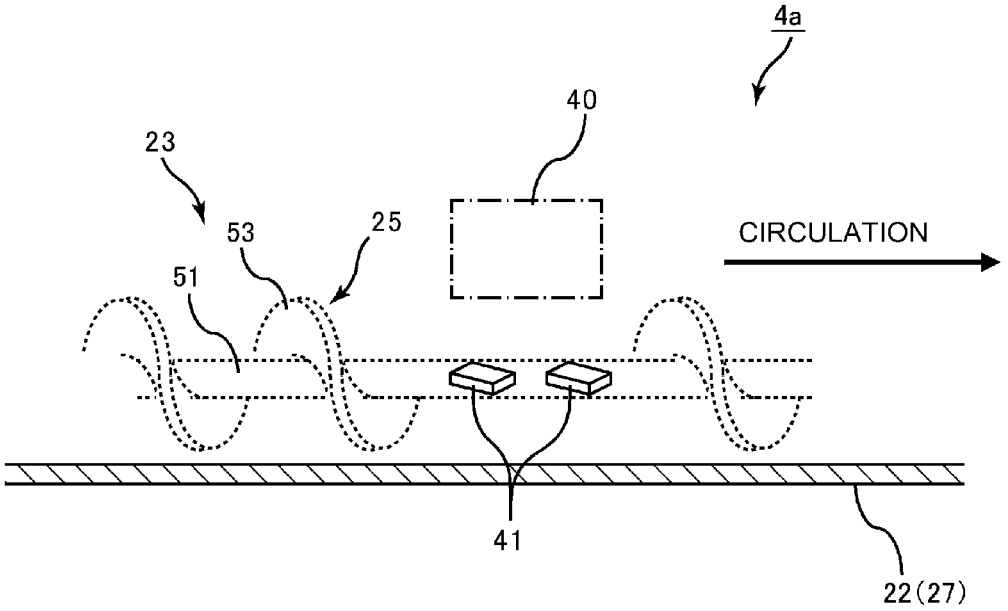
FIG. 14 is an illustration of a rib shape in a developing device in Modified Embodiment 2.

FIG. 13 is an illustration of a rib shape in a developing device in Modified Embodiment 1. FIG. 14 is an illustration of a rib shape in a developing device in Modified Embodiment 2.

The present invention can be carried out in other embodiments in which a part or all of constituent elements are replaced with their alternative constituent elements. In Embodiment 1, the developing device of the vertical stirring type in which the first and second openings (openings 11 and 12) are disposed on the bottom of the first feeding path (developing chamber 23) and in which the second feeding path (stirring chamber 24) is disposed below the first feeding path (developing chamber 23) was described.

However, when the developing device is of such a function-separation type that the first feeding path supplies the developer to the developer carrying member and the second feeding path collects the developer from the developer carrying member after being used for development, a constitution in which the first feeding path and the second feeding path are disposed horizontally or obliquely adjacent to each other may also be employed. The developing device may only require that the room from which the developer is supplied to the developing sleeve and the room (stirring chamber) into which the developer after passing through the developing portion and being used for the development is collected from the developing sleeve are separated from each other.

In general, when an average angle formed between the stirring surface of the rib 41 and the rotation shaft of the first screw 25 is smaller than an average angle formed between the feeding surface and the rotation shaft of the first stirring chamber 25 in the second region, the developer leveling effect as in Embodiment 1 can be obtained. Accordingly, the rib member may also have a rectangular shape as shown in FIG. 13. Further, as shown in FIG. 14, the rib member may also have such a shape that rectangular portions are disposed with a somewhat angle with respect to the screw rotation shaft.

The first screw 25 in the first region E1 shown in FIG. 4 may also be formed only with the screw shaft by removing the rib 41 in addition to the removal of the screw blade. Further, the first screw 25 in the first region E1 may also be configured to include the screw blade small in outer diameter without removing the screw blade. It is also possible to employ a combination of the screw blade small in outer diameter and the rib 41. In FIG. 4, the screw blade is removed from the first region E1, but the screw blade in the first region E1 may only be required to be smaller in outer diameter than the screw blade in the second region E2.

In the developing device in the present invention, the relationships of S'≤R"p1/p1' and R2p2ω2≤R"p1ω1 hold, and therefore the downsizing of the developing device is not prevented. Further, the relationships of R"αp1/p1'≤S' and R"αp1ω1≤R2p2ω2 hold, and therefore the developer stagnates in the second feeding path and at the first discharge opening, so that the developer surface in the region along the discharge opening is not excessively raised.

Accordingly, the toner stagnation in the neighborhood of the second opening is suppressed, so that it is possible to provide the developing device from which the developer in the unintended amount is not readily discharged through the discharge opening.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-107576 filed on May 23, 2014, which is hereby incorporated by reference herein in its entirety.

What is claimed is:

1. A developing device comprising:

a developer carrying member including a carrying region of a developer containing a toner and a carrier;

first and second feeding paths, provided along said developer carrying member, for forming a circulating path of the developer by establishing communication through a first opening and a second opening at end portions;

a first screw member, including a screw blade, for supplying the developer to said developer carrying member while feeding the developer delivered from said second feeding path through the first opening by being rotated in said first feeding path;

a second screw member, including a screw blade, for feeding the developer delivered from said first feeding path through the second opening and the developer collected from the carrying region by being rotated in said second feeding path; and a discharging portion capable of discharging a part of the developer in said first feeding path through a discharge opening, provided in a first region between the carrying region and the second opening in said first feeding path, by causing the part of the developer to overflow said first feeding path, wherein said first screw member in the first region has no screw blade or has the screw blade smaller in diameter than those in a second region upstream of the first region and a third region downstream of the first region with respect to a developer feeding direction, and wherein when a ratio of a developer feeding speed in the first region to a developer feeding speed in the second region is $\alpha$, a screw blade pitch of said first screw member in the second region is p1, a screw blade pitch of said first screw member in the third region is p1', a rotational speed of said first screw member is $\omega 1$, a maximum of a cross-sectional area of a flow path lower than a lower end of the discharge opening in an axially vertical cross section including the discharge opening of said first feeding path is R", and an opening area of the second opening is S', the following relationship is satisfied:

$$R''\alpha p1/p1' \leq S' \leq R''p1/p1'.$$

2. A developing device according to claim 1, wherein $p1 \leq p1'$ is satisfied.

3. A developing device according to claim 1, further comprising a supplying portion for supplying a supply developer containing the toner and the carrier at a position upstream of the second opening of said second feeding path with respect to a developer circulation direction with image formation.

4. A developing device according to claim 1, wherein said first screw member in the first region includes a projection having a stirring surface smaller in inclination angle with respect to a rotational axis than that of the screw blade of said first screw member.

5. A developing device according to claim 1, wherein said first screw member in the third region has the screw blade extending in a length of 1 pitch or more.

6. A developing device according to claim 1, wherein said second feeding path is disposed below said first feeding path, and the first opening and the second opening are disposed adjacently to a bottom of said first feeding path.

7. A developing device according to claim 1, wherein a distance from a downstream end to an upstream end of the discharge opening in said first feeding path with respect to the developer feeding direction is smaller than 1 pitch of the screw blade of said first screw member.

8. A developing device according to claim 1, wherein in a region opposing the second opening in said second feeding path, when a cross-sectional area of a developer flowing path in an axially vertical cross section of said second screw member is R2, a screw blade pitch of said second screw member opposing the second opening is p2, and a rotational speed of said second screw member is $\omega 2$, the following relationship is satisfied:

$$R''\alpha p1\omega 1 \leq R2p2\omega w2 \leq R''p1\omega 1.$$

9. A developing device according to claim 1, wherein the following relationship is satisfied:

$$R''\alpha p1/p1' \leq S' \leq R''p1/p1'.$$

* * * * *